US009631883B2

(12) United States Patent
Grandy

(10) Patent No.: US 9,631,883 B2
(45) Date of Patent: Apr. 25, 2017

(54) REVERSIBLE-LOADING MAGAZINE FOR FIREARMS

(71) Applicant: Michael A. Grandy, Warrington, PA (US)

(72) Inventor: Michael A. Grandy, Warrington, PA (US)

( * ) Notice: Subject to any disclaimer, the term of this patent is extended or adjusted under 35 U.S.C. 154(b) by 0 days.

(21) Appl. No.: 14/756,075

(22) Filed: Jul. 29, 2015

(65) Prior Publication Data

US 2016/0033220 A1 Feb. 4, 2016

Related U.S. Application Data

(60) Provisional application No. 61/999,554, filed on Jul. 30, 2014.

(51) Int. Cl.

| | |
|---|---|
| ***F41A 9/70*** | (2006.01) |
| ***F41A 9/63*** | (2006.01) |
| ***F41A 9/65*** | (2006.01) |
| ***F41A 9/68*** | (2006.01) |

(52) U.S. Cl.

CPC *F41A 9/70* (2013.01); *F41A 9/63* (2013.01); *F41A 9/65* (2013.01); *F41A 9/68* (2013.01)

(58) Field of Classification Search

CPC ..... F41A 9/65–9/72; F41A 9/63
USPC ..... 42/49.01, 50
See application file for complete search history.

(56) References Cited

U.S. PATENT DOCUMENTS

| | | | | |
|---|---|---|---|---|
| 3,191,332 A * | 6/1965 | Ardolino | F41A 9/63 | 42/50 |
| 3,623,256 A * | 11/1971 | Shiplee, III | F41A 9/63 | 42/50 |
| 4,447,976 A * | 5/1984 | Cooper | F41A 9/63 | 42/18 |
| 4,685,238 A * | 8/1987 | Schoepflin | F16B 5/0004 | 42/90 |
| 5,615,506 A * | 4/1997 | Jackson | F41A 9/63 | 42/50 |
| 7,497,044 B2 * | 3/2009 | Cammenga | F41A 9/67 | 42/49.01 |

(Continued)

*Primary Examiner* — Stephen M Johnson
*Assistant Examiner* — Joshua Semick
(74) *Attorney, Agent, or Firm* — Armand M. Vozzo, Jr.

(57) ABSTRACT

A reversible-loading magazine device is disclosed for supplying stored cartridges to a repeating firearm upon inserted engagement therewith in opposite directions. The magazine device comprises a first and second outer casing adapted for joint engagement, each outer casing being formed having a respective compartment to hold stored cartridges therein and a restricted slotted opening at an outer distal end of each casing to permit a forced passage of the cartridges to and from the respective compartments. Inner proximal ends of each casing are fully open and further adapted to engage together about their interface so that the casings are joined together with the respective compartments therein. A spring-loaded follower assembly disposed longitudinally within the joined outer casings and fitted for movement between the respective compartments serves to urge the stored cartridges outbound through each respective compartment in opposite directions so that upon emptying one compartment, the magazine device may be removed and reloaded in the reverse direction to feed the stored cartridges to the firearm from the remaining compartment.

12 Claims, 3 Drawing Sheets

(56) References Cited

U.S. PATENT DOCUMENTS

| | | | | |
|---|---|---|---|---|
| 7,975,420 | B2 * | 7/2011 | Pestana | F41A 9/63<br>224/931 |
| 8,069,601 | B1 * | 12/2011 | Fitzpatrick | F41A 9/62<br>42/50 |
| 8,819,977 | B2 * | 9/2014 | Corso | F41A 9/70<br>42/49.01 |
| 8,887,428 | B1 * | 11/2014 | Lemoine | F41A 9/61<br>42/49.01 |
| 2016/0003567 | A1 * | 1/2016 | Purkiss | F41A 9/68<br>42/49.01 |

* cited by examiner

REVERSIBLE-LOADING MAGAZINE FOR FIREARMS

CROSS-REFERENCE TO RELATED APPLICATION

This application is a continuation-in-part of U.S. provisional patent application Ser. No. 61/999,554 filed Jul. 30, 2014 for a Reversible-Loading Magazine for Firearms.

BACKGROUND OF THE INVENTION

The present invention relates to magazines used to supply firearms with a steady supply of ammunition and, more particularly, to an improved magazine device for supplying an increased store of primed cartridges to a firearm by means of a casing capable of being inserted into the firearm in reverse directions to load the full supply of stored cartridges during a single round.

In the history of use of repeating firearms, both those of the automatic and semi-automatic varieties, there has existed a longstanding desire to afford the operator with an increased capacity of immediately available ammunition that can be fired in a single round. Driven by this recognized desire for providing increased ammunition capacity to repeating firearms, many design improvements have been presented and made over the years to ammunition magazines that are able to hold a large supply of primed cartridges stored within their structure and be detachably engaged to the firearm structure immediately adjacent to its firing chamber to repeatedly feed the stored cartridges for firing. While these large capacity ammunition magazines found in the prior art have worked effectively for the most part in continuously feeding increased cartridge supplies to the repeating firearms for which they have been designed and developed, there have been some limitations recognized in their handling and reliability particularly due to their bulkiness and complicated working structures that generally rely on the configuration and contours within the chambers of the magazines and the cooperative interactions of spring-loaded follower assemblies commonly disposed within the magazine chambers of these prior art devices to urge the stored ammunition outward and into the firing chamber.

Characteristic of the majority of these relevant large capacity ammunition magazines is a casing compartment that is structurally configured to contain an increased store of cartridges within a specially formed chamber with one or more dividing walls or ribs disposed within the chamber to channel or guide the flow of the cartridges. The structural configuration of the casing compartment varies, but commonly includes a form that is convergent from a fixed bottom to an open top section with some transition in between so that multiple rows/columns of cartridges can be stored and moved upward through the compartment using a single or dual follower assembly and transitioned into a single open mouth at the top. This type of structural characterization applies to the prior art magazine devices of Schillstrom (U.S. Pat. No. 2,217,848), Howard (U.S. Pat. No. 4,472,900), Fitzpatrick et al. (U.S. Pat. No. 8,061,071), and Hogan Jr. (U.S. Pat. No. 8,365,454) all of which operate in a unidirectional fashion. Another type of these increased capacity magazine devices is designed and adapted to feed its stored cartridges in a bidirectional fashion and is required to be removed by the operator after the initial directional feed is depleted and reinserted to feed the remaining store of cartridges. An example of this type of bidirectional feed device is found in the multi-compartment box-magazine shown and described in Owsley (U.S. Pat. No. 2,289,067). This type of bidirectional feed device is seen as useful and helpful from the standpoint of increasing the stored supply of cartridges in a single magazine unit. However, the structural configuration and operational features of the prior art devices of this bidirectional type, as particularly seen in the multi-compartment box-magazine package of Owsley, can be cumbersome and problematic, especially in light of the handling of the magazine that is required by the operator in order to reverse the directional flow of the cartridges. Therefore, a need exists for an improved magazine having increased cartridge storage capacity and the capability of being used and handled with ease and simplicity to rapidly feed the stored cartridges in a bidirectional fashion without undue interruption or difficulty.

SUMMARY OF THE INVENTION

Accordingly, it is a general purpose and object of the present invention to provide an improved magazine device for a repeating firearm that is capable of storing an increased supply of ammunition and feeding the stored supply to the firearm inline and in opposite directions.

A more particular object of the present invention is to provide an improved magazine for a repeating firearm that can be detachably engaged to the firearm in opposite directions to provide readily available ammunition for firing particularly where round limitations have been imposed.

Another object of the present invention is to provide an improved reversible-loading magazine device for repeating firearms that is simple yet effective in its operation and easy for the operator to handle and manipulate during firing sessions.

Still another object of the present invention is to provide an improved reversible-loading magazine device that is easy to carry and store on the operator's person and reusable when emptied.

A still further object of the present invention is to provide an improved reversible-loading magazine device that is inexpensive to manufacture, simple to assemble, and easy to use.

Briefly, these and other objects of the present invention are accomplished by a reversible-loading magazine device for supplying stored cartridges to a repeating firearm upon inserted engagement therewith in opposite directions as needed. The magazine device comprises a first and second outer casing adapted for joint engagement, each outer casing being formed having a respective compartment to hold stored cartridges therein and a restricted slotted opening at an outer distal end of each casing to permit a forced passage of the cartridges to and from the respective compartments Inner proximal ends of each casing are fully open and further adapted to engage together about their interface so that the casings are joined together with the respective compartments therein. A spring-loaded follower assembly disposed longitudinally within the joined outer casings and fitted for movement between the respective compartments serves to urge the stored cartridges outbound through each respective compartment in opposite directions so that upon emptying one compartment, the magazine may be removed and reloaded in the reverse direction to feed the stored cartridges to the firearm from the remaining compartment.

For a better understanding of these and other aspects of the present invention, reference should be made to the following detailed description taken in conjunction with the accompanying drawings in which like reference numerals and character designate like parts throughout the figures thereof.

BRIEF DESCRIPTION OF THE DRAWINGS

For a fuller understanding of the nature and objects of the present invention, references in the detailed description set forth below shall be made to the accompanying drawings in which.

DESCRIPTION OF THE INVENTION

Figure 3:
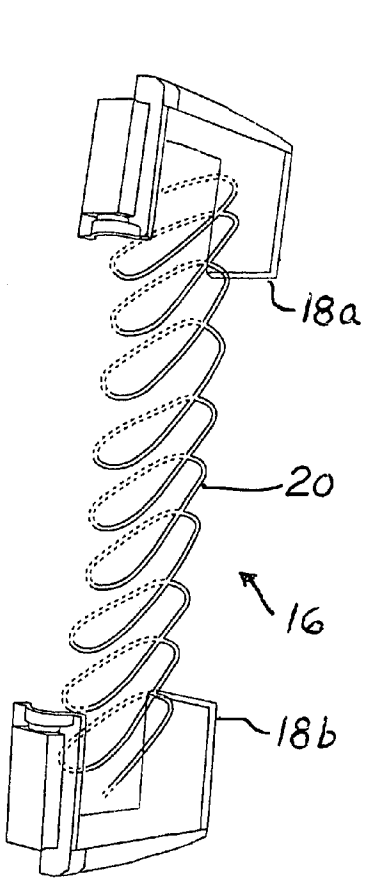
FIG. 3 is a perspective side view of the follower assembly of the present magazine device here shown removed from the respective outer casings of FIGS. 2*a* and 2*b;*

The following serves to describe a preferred embodiment of the present invention and the best presently contemplated mode of its production and practice. This description is further made for the purpose of illustrating the general principles of the invention but should not be taken in a limiting sense, the scope of the invention being best determined by reference to any associated claims.

Referring to the drawings, the following is a list of structural components of the present magazine device, generally designated 10, and those associated structural elements shown employed in connection with the present invention:

10 magazine device;
12 first or upper outer casing;
12*a* slotted opening;
12*b* skirt;
12*c* fastener slot;
14 second or lower outer casing;
14*a* slotted opening;
14*b* collar
14*c* fastener member;
16 follower assembly;
18*a* upper follower member;
18*b* lower follower member;
20 compression spring;
C cartridge;
F firearm; and
W magazine well.

Figure 1:
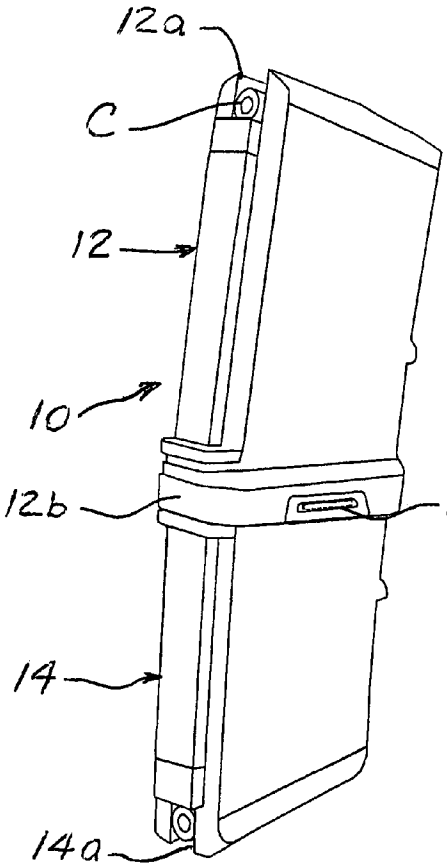
FIG. 1 is a perspective side view of a preferred embodiment of the magazine device made in accordance with the present invention shown stored with cartridges and intended for inserted engagement to a firearm.
Figure 5:
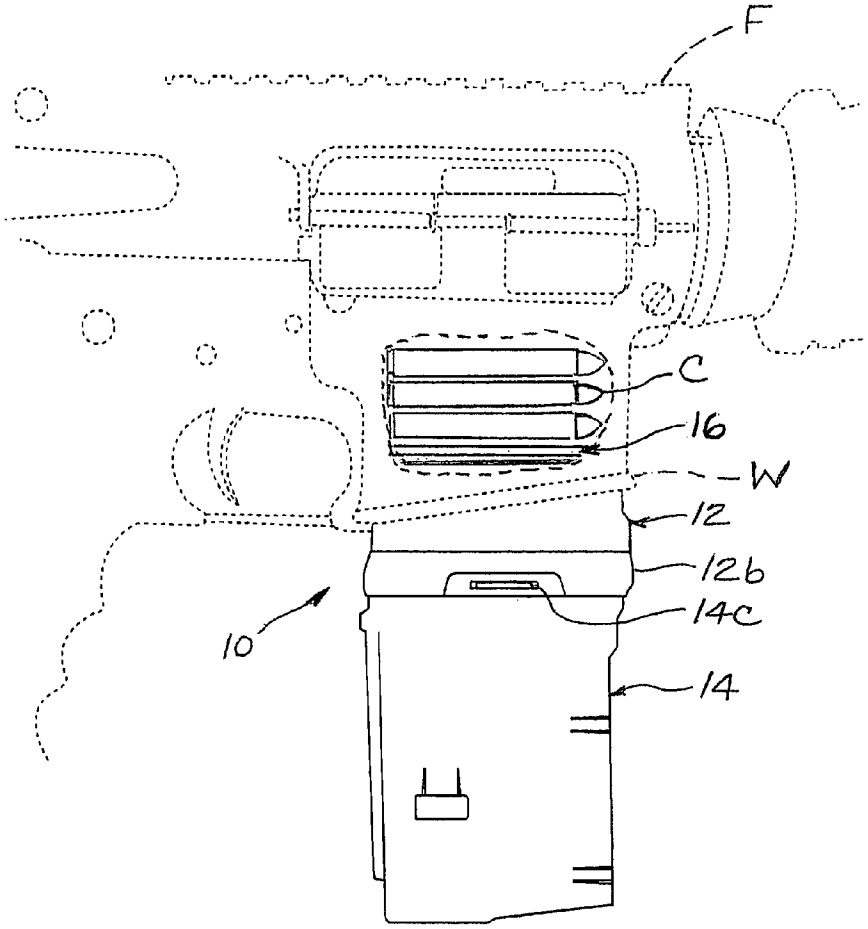
FIG. 5 is a side elevation view of the magazine device of FIG. 1 shown here inserted and engaged for operation within a magazine well of a firearm (in phantom outline) with a portion of the magazine well cut away.

Referring initially to FIG. 1, the present magazine device 10 is shown constructed and assembled in accordance with the present invention, loaded with a stored supply of cartridges C and ready for inserted engagement within a firearm F (shown in phantom in FIG. 5). In its assembled state, the present magazine device 10 presents a rigid and substantially closed box-like structure that may be gripped firmly by the operator when handling is necessary and held securely in place when inserted into the firearm F, typically within a magazine well W or other similar port for loading ammunition to the firearm as shown in FIG. 5.

In accordance with the present invention, the magazine device 10 comprises a first or upper outer casing 12 and a second or lower outer casing 14, each of the casings being complemental in form and structure and adapted to be joined together connected along a mating interface. Both outer casings 12 and 14 are formed having similar side walls extending longitudinally between opposite ends of the casing and laterally surrounding an inner chamber or compartment within each casing intended to hold and contain a separate store of cartridges C. The first and second outer casings 12 are generally lightweight but rigid members each having a substantially rectilinear form designed internally to hold and contain the stored cartridges in a linear or staggered stack and externally to fit securely into proper engagement with the firearm. The separate outer casings 12 and 14 are similarly sized and shaped except for the respective formations of a skirt 12*a* and collar 14*a*, described in greater detail below, about their mating interface, and are preferably molded and fabricated from a durable, high-strength and damage-resistant thermoplastic material.

Each outer casing 12 and 14 is further formed and provided with a respective slotted opening 12*a* and 14*a* at one end thereof, each slotted opening being like that found on conventional casings to permit the loading insertion of cartridges into the casing compartments and further restrict the outward flow of the cartridges feeding into the firearm, guiding a release of the cartridges when urged from the respective compartments as described below in greater detail. The slotted openings 12*a* and 14*a* of the respective first and second outer casings 12 and 14 when joined and connected together, as seen in FIG. 1, are situated at opposite ends of the assembled magazine device 10 and thus disposed at the outer end of each casing distal in relation to the mating interface between the joined casings.

Figure 2A:
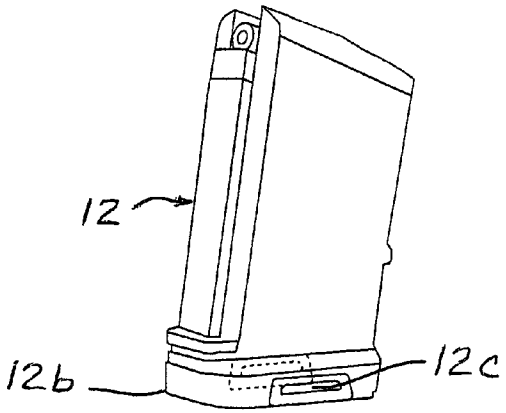
FIGS. 2*a* and 2*b* is a perspective side view of the separated outer casings of the present magazine device of FIG. 1 shown here disengaged and without the follower assembly normally contained therein.
Figure 2B:
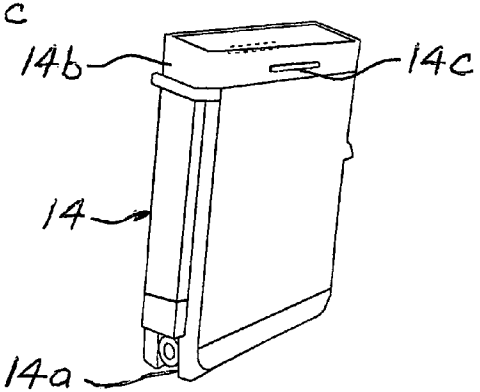

Referring now to FIGS. 2*a* and 2*b* in conjunction with FIG. 1, the ends of the first and second outer casings 12 and 14 opposite from the slotted openings 12*a* and 14*a* are each made fully open to the compartments within each casing. The open ends of the respective outer casings 12 and 14 are further formed about their perimeter edges with mating configurations in the form of a slightly expanded skirt 12*b* surrounding the open end of the first outer casing and a slightly reduced collar 14*b* surrounding the open end of the second outer casing, with the skirt being sized and shaped to fit closely over and upon the collar to provide the mating interface between the respective casings. A pair of slots 12*c* formed through the surface of the skirt 12*b* preferably on opposite lateral sides thereof are positioned in alignment and made to conform with a pair of fastener members 14*c* raised along the surface of the collar 14*b* and thereby snap together in engagement to secure the joint between the outer casings 12 and 14 connect them together along their mating interface.

Referring now to FIG. 3 in conjunction with FIGS. 2*a* and 2*b*, a spring-loaded follower assembly 16 is formed to fit within the extended compartments of the joint outer casings 12 and 14 and move throughout the outer casings in a longitudinal direction. The follower assembly 16 here employed in the present magazine device 10 is of a typical design including a pair of follower members 18*a* and 18*b* secured at opposite ends of a compression spring 20. The compression spring 20 in this case is a helical coil type, preferably made from a hard drawn or spring steel wire, formed having its coil cross-section substantially conforming but slightly smaller than that of the inner compartment of the casings 12 and 14 and further having its free length cut to substantially the length of the combined casing compartments. The follower members 18*a* and 18*b*, typically made from the same material as that of the outer casings 12 and 14, are each formed having a U-shaped rectilinear configuration that is fitted to engage the opposite ends of the compression spring 20 within the U-shaped openings of the members. Side walls of the follower members 18*a* and 18*b* extend to define the U-shaped opening and are configured to conform to the inner side walls of the casings and thereby register and align the movement of the follower assembly 16 through the casings with the follower members oriented having their respective U-shaped openings inwardly directed and with compression spring 20 expanding and retracting therebetween.

Figure 4:
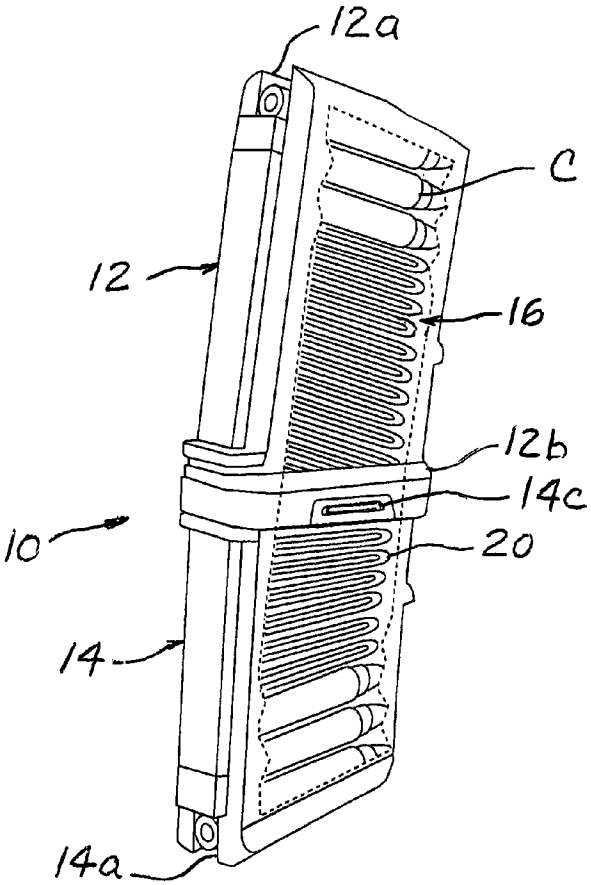
FIG. 4 is a perspective side view of the present magazine device of FIG. 1 shown here with the facing side walls of the respective outer casings removed.

In this working arrangement of the follower assembly 16 operatively disposed within the joined outer casings 12 and 14, as best seen in FIG. 4, the transverse surfaces of each follower member 18*a* and 18*b* come into direct contact with the stored cartridges C loaded into the respective compartments of the joined first and second outer casings 12 and 14 and thereby apply the forces of the compression spring 20 within the respective compartments. By means of this working arrangement, the follower assembly extending longitudinally throughout the joined outer casings 12 and 14 of the present magazine device 10 serves to urge the stored cartridges outbound through each respective compartment in opposite directions so that upon emptying one compartment through its respective slotted opening 12*a* or 14*a*, the assembled magazine device may be removed and reloaded in the reverse direction to feed the stored cartridges to the firearm from the remaining compartment.

Referring further to FIG. 4, to assemble the present magazine device 10, the follower assembly 16 is inserted longitudinally within the open ends of the separate outer casings 12 and 14 with the follower members 18*a* and 18*b* each being positioned to engage the inner side walls of the respective first and second casings and the compression spring 20 extending therebetween. With the follower assembly 16 thus in place, the open ends of the respective first and second casings 12 and 14 are engaged and connected together to complete assembly of the magazine device 10, with the skirt 12*b* formed on the first casing being closed upon and over the collar 14*b* on the second casing and the respective slots 12*c* on the skirt snap in engagement with the fastener members 14*c* on the collar to secure the connection of the assembled device. In this assembled state of the magazine device 10, the follower assembly 16 should substantially extend through the entire interior length of the joined casings 12 and 14 with the respective follower members 18*a* and 18*b* reaching the respective slotted ends 12*a* and 14*a* of the casings and the compression spring 20 extending in its free length through the casing compartments. This extended disposition of the follower assembly 16 will allow a maximum number of cartridges C to be loaded through the respective slotted ends 12*a* and 14*a* and stored within the respective casing compartments on either side of the follower assembly 16, and further maximize the compressive forces exerted axially in either direction upon the compression spring 20.

Referring now to FIG. 5, the assembled and fully loaded magazine device 10 is capable of being inserted manually into the magazine well W or other similar port provided for loading ammunition to the firearm F, with either slotted end 12*a* or 14*a* of the joined outer casings 12 and 14 leading the initial insertion. With the spring-loaded follower assembly 16 subjected to compressive forces axially exerted thereon by the stored cartridges C in the casing compartments on both sides, the present magazine device 10 will function initially like conventional detachable box magazines that move the cartridges stored in the magazine in a single direction to a position where they may be loaded into the chamber by the action of the firearm F. However, different from conventional box magazines, after moving all the stored cartridges C outbound through the slotted end of the initially-engaged casing compartment, the present magazine device 10 may be detached from the magazine well W of the firearm F, flipped in its direction, and reinserted in the reverse direction to feed the stored cartridges to the firearm from the remaining second casing compartment. It should be understood that when each casing compartment is empty, as a common safety feature evident in conventional magazine designs, the follower members 18*a* and 18*b* by means of their configurations will serve to stop the bolt of the firearm F from engaging the chamber, informing the operator that the firearm is empty.

Therefore, it is apparent that the described invention provides an improved magazine device for a repeating firearm that is capable of storing an increased supply of ammunition and feeding the stored supply to the firearm inline and in opposite directions. More particularly, the described invention provides an improved reversible-loading magazine device for a repeating firearm, especially beneficial where round limitations have been imposed, that can be detachably engaged to the firearm in alternate directions to provide a rapid, steady flow of readily available ammunition. The present magazine device, as described and shown, is simple yet effective in its operation and easy for the operator to handle and manipulate during firing sessions. The described magazine device is also easy to carry and store on the operator's person and can be reloaded and used when emptied. Furthermore, the present magazine device is inexpensive to manufacture, simple to assemble, and easy to use.

Obviously, other embodiments and modifications of the present invention will readily come to those of ordinary skill in the art having the benefit of the teachings presented in the foregoing description and drawings. Alternate embodiments of different shapes and sizes, as well as substitution of known materials or those materials which may be developed at a future time to perform the same function as the present described embodiment are therefore considered to be part of the present invention. Furthermore, certain modifications to the described embodiment that serve to benefit its usage are within the scope of the present invention. Accordingly, it is understood that this invention is not limited to the particular embodiment described, but rather is intended to cover modifications within the spirit and scope of the present invention as expressed in the appended claims.

What is claimed is:

1. A reversible-loading magazine device for supplying stored cartridges to a firearm, comprising:

a pair of outer casings each constructed with a compartment formed longitudinally therein to store the cartridges and further adapted for a joint engagement together with the respective compartments being extended and substantially aligned therethrough, said outer casings each having a slotted opening formed at one end for feeding the cartridges therethrough and a transverse opening formed at the opposite end thereof with the transverse openings of the respective outer casings formed having mating configurations to provide an interface for the joint engagement; and means for following assembled within said pair of outer casings and operatively disposed for movement through the extended compartments to urge cartridges outwardly through the extended compartments of the joined outer casings in opposite longitudinal directions, said means for following comprising a compression spring having a coiled length disposed longitudinally through the extended compartments and a pair of follower members formed to fit transversely within the compartments, one of said pair of follower members being secured at each end of the length of said compression spring to feed cartridges to the firearm through the respective slotted openings at each end of said joined outer casings in reversible fashion.

2. A reversible-loading magazine device according to claim 1, wherein the mating configurations of the transverse openings of said pair of outer casings are in the respective forms of an extended skirt provided on one of said outer casings and an extended collar fitted to engage the skirt provided on the other of said outer casings.

3. A reversible-loading magazine device according to claim 2, wherein:

the extended skirt is formed having a surface sized and shaped to fit closely over and upon the extended collar with a plurality of slots formed in the skirt surface; and the extended collar is formed having a surface provided with a plurality of raised fastener members made to align and conform with the slots thereby snap together in engagement to secure the joint between said outer casings.

4. A reversible-loading magazine device according to claim 1 wherein said follower members are each formed having a U-shaped rectilinear configuration with extending side walls internally fitted to engage the opposite ends of said compression spring and externally configured to conform to the sides of the extended compartments of the joined outer casings for guiding the longitudinal movement of said follower members therethrough.

5. A reversible-loading magazine device for supplying cartridges to a firearm, comprising:

a first outer casing formed having a longitudinal compartment formed therein adapted to hold the cartridges, said first outer casing being further formed having a slotted opening at one end thereof to feed the cartridges therethrough and a transverse opening formed at the opposite end across the longitudinal compartment;

a second outer casing formed having a longitudinal compartment formed therein adapted to hold the cartridges, said second outer casing being further formed having a slotted opening at one end thereof to feed the cartridges therethrough and a transverse opening formed at the opposite end across the longitudinal compartment, the transverse opening of said second outer casing being formed for fitted engagement with the transverse opening of said first outer casing to join said outer casings together with their respective compartments being extended and substantially aligned therethrough; and means for following assembled within said first and second outer casings and operatively disposed for movement through the extended compartments thereof, said means for following comprising a compression spring having a coiled length disposed longitudinally through the extended compartments and a pair of follower members formed to fit transversely within the compartments, one of said pair of follower members being secured at each end of the length of said compression spring to urge cartridges through the extended compartments outwardly in opposite longitudinal directions and thereby supply cartridges to the firearm through respective slotted openings of said outer casings in reversible fashion.

6. A reversible-loading magazine device according to claim 5, wherein said follower members are each formed having a U-shaped rectilinear configuration with extending side walls internally fitted to engage the opposite ends of said compression spring and externally configured to conform to the sides of the extended compartments for guiding the longitudinal movement of said follower members therethrough.

7. A reversible-loading magazine device according to claim 5, wherein:

the transverse opening of said first outer casing is formed having an extended skirt; and the transverse opening of said second outer casing is formed having an extended collar fitted to engage the extended skirt of said first outer casing.

8. A reverse-loading magazine device according to claim 7, wherein:

the extended skirt is formed having a surface sized and shaped to fit closely over and upon the extended collar with a plurality of slots formed in the skirt surface; and the extended collar is formed having a surface provided with a plurality of raised fastener members made to align and conform with the slots and thereby snap together in engagement to secure the joint between said outer casings.

9. A reversible-loading magazine device for supplying cartridges to a firearm, comprising:

a pair of complemental outer casings adapted for joint engagement, each outer casing being formed having a slotted opening at one end thereof to feed cartridges therethrough, a transverse opening at the opposite end thereof and a respective compartment formed longitudinally from the slotted opening to the respective transverse opening of each of said outer casings;

interface engagement means for joining said pair of outer casings across the transverse openings thereof with the respective compartments being extended and aligned longitudinally therethrough; and means for following assembled within the outer casings and operatively disposed for movement through the extended compartments thereof, said means for following comprising a compression spring having a coiled length disposed longitudinally through the extended compartments and a pair of follower members formed to fit transversely within the compartments, one of said pair of follower members being secured at each end of the length of said compression spring to urge cartridges through the extended compartments outwardly in opposite longitudinal directions and thereby supply cartridges to the firearm through respective slotted openings of the joint casings in reversible fashion.

10. A reversible-loading magazine device according to claim 9, wherein said interface engagement means comprises:

a skirt member fitted for attachment to one of said pair of outer casings about the transverse opening thereof; and a collar member fitted for attachment to the other of said pair of outer casings about the transverse opening thereof, said collar member being sized and shaped to releasably engage said skirt member.

11. A reversible-loading magazine device according to claim 10, wherein:

said skirt member is formed having a surface sized and shaped to fit closely over and upon said collar member with a plurality of slots formed in the surface of said skirt member; and said collar member is formed having a surface provided with a plurality of raised fastener members made to align and conform with the slots on said skirt member to snap together in engagement and secure the joint between said outer casings.

12. A reversible-loading magazine device according to claim 11, wherein said follower members are each formed having a U-shaped rectilinear configuration with extending side walls internally fitted to engage the opposite ends of said compression spring and externally configured to conform to the sides of the extended compartments for guiding the longitudinal movement of said follower members therethrough.

* * * * *